US006381839B1

(12) United States Patent
Hollesen et al.

(10) Patent No.: US 6,381,839 B1
(45) Date of Patent: May 7, 2002

(54) TOOL AND METHOD FOR ASSEMBLY OF IDC STRAIN RELIEF CAPS

(75) Inventors: David B. Hollesen, Belle Mead, NJ (US); Ivan Pawlenko, Holland, PA (US); Thelma E. Cole, Neshamic Station, NJ (US); Jason A. Kay, Morristown; David S. Kerr, Mendham, both of NJ (US)

(73) Assignee: Avaya Technology Corp, Basking Ridge, NJ (US)

( * ) Notice: Subject to any disclaimer, the term of this patent is extended or adjusted under 35 U.S.C. 154(b) by 0 days.

(21) Appl. No.: 09/482,899

(22) Filed: Jan. 14, 2000

(51) Int. Cl.[7] ..... H01R 43/04

(52) U.S. Cl. ..... 29/866; 29/857; 29/861; 29/864; 29/865

(58) Field of Search ..... 29/857, 861, 863, 29/865, 866

(56) References Cited

FOREIGN PATENT DOCUMENTS

GB 1193832 * 6/1970 ..... 29/867

* cited by examiner

*Primary Examiner*—Carl J. Arbes
(74) *Attorney, Agent, or Firm*—Woodbridge & Associates, P.C.

(57) ABSTRACT

A method secures wire to an electrical contact using an insulation displacement contact (IDC) strain relief cap. The electrical contact has a bifurcated end for engaging and retaining the wire and is engaged with the strain relief cap in securing the wire. The cap attaches to the contact via means on the electrical contact for engaging both the cap and the wire. The wire is secured by placing cap onto the contact, aligning the wire with exit holes, and turning cap until locked into place.

8 Claims, 3 Drawing Sheets

TOOL AND METHOD FOR ASSEMBLY OF IDC STRAIN RELIEF CAPS

BACKGROUND OF THE INVENTION

1. Field of the Invention.

This invention relates to an electrical connector for insulation displacement contact (IDC) with insulation conducting wire. The invention finds particular utility in telecommunications where wires terminate in central office and building entrances.

2. Description of Prior Art.

It is common to find the use of insulation displacement contact (IDC) technology in the electrical connector industry, because it allows rapid and simple connection of conducting wires to terminals without stripping nor crimping. A typical IDC connection is made by disposing an insulated conducting wire perpendicular to a planar wall portion comprising an IDC slot stuffing a wire into the slot such that. edges thereof cut through the insulation and make electrical contact with conducting strands of a wire. The IDC slots are generally formed by opposed edges of the sheet metal wall portion which is necessarily of a certain width to have sufficient strength to support the contact pressure against the edges.

Commercially available connectors that utilize insulation displacement contact (IDC) technology provide strain relief for multiple conductors. IDC pins are molded into the connector body which is used to support the strain relief member. These commercially available connectors are, designed to terminate multiple conductors in a single connector. Strained relief for these types of connectors are designed as an intregal part of the connector body securing all conductors within a single strain relief member. Although this technology finds particular applicability when multiple wires are to be connected and unconnected, it does not lend itself to large pin array connectors where individual wires need to be reworked or rerouted without jeopardizing adjacent connections. Strain relief of the individual contacts or pins provide a great benefit during reworking or rerouting of individual wires.

SUMMARY OF THE INVENTION

It is a primary object of the present invention to provide strain relief for individual IDC pins or contacts.

It is another object of the invention to provide individual strain relief pins that make IDC a viable technology for large pin array connectors.

A further object of the invention is to provide strain relief for individual pins or contacts to allow for rapid assembly of large pin arrays.

Yet a further object of the invention is to provide strain, relief for individual IDC connections to ensure robust electrical connections, while allowing wiring changes and repairs without compromising adjacent electrical connections.

It is yet another object of the invention to provide strain relief for individual IDC pins or contacts to replace wire wrap technology on current products.

The foregoing objects have been accomplished by providing a tool and an IDC strain relief cap that operates in conjunction with an IDC contact to rapidly retain an insulated wire with the contact.

DETAILED DESCRIPTION OF THE INVENTION

Figure 1:
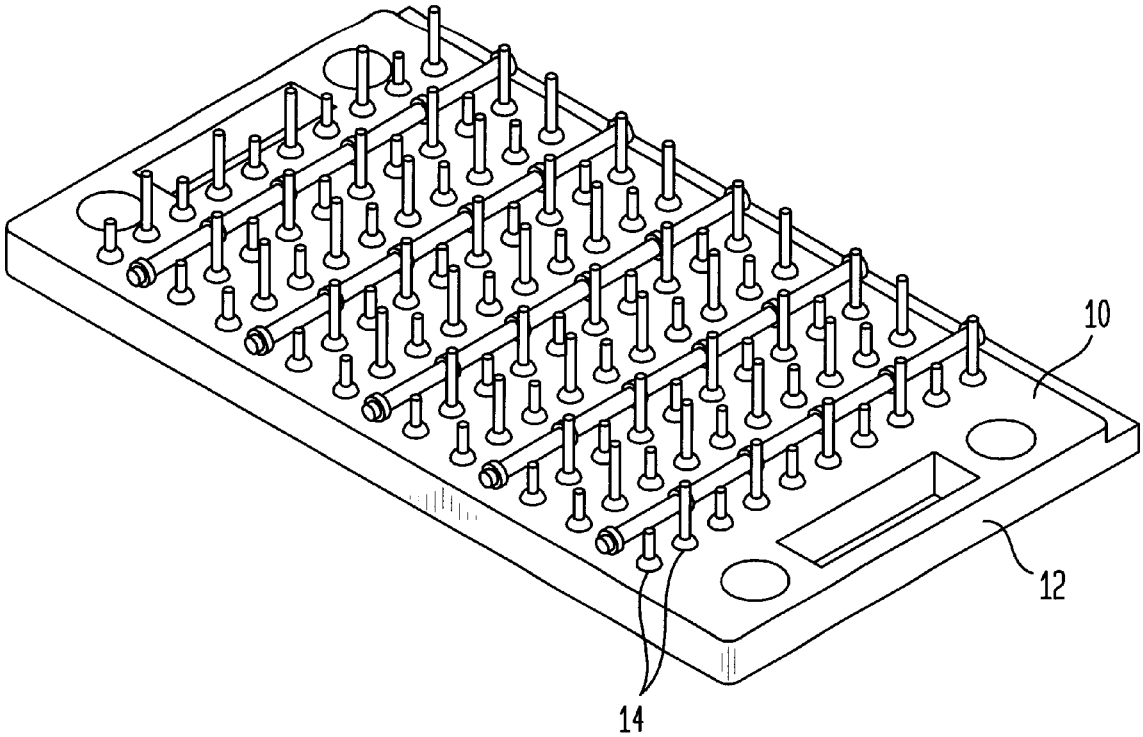
FIG. 1 is an isometric back view of a current projection block having wire wrap pins.
Figure 2:
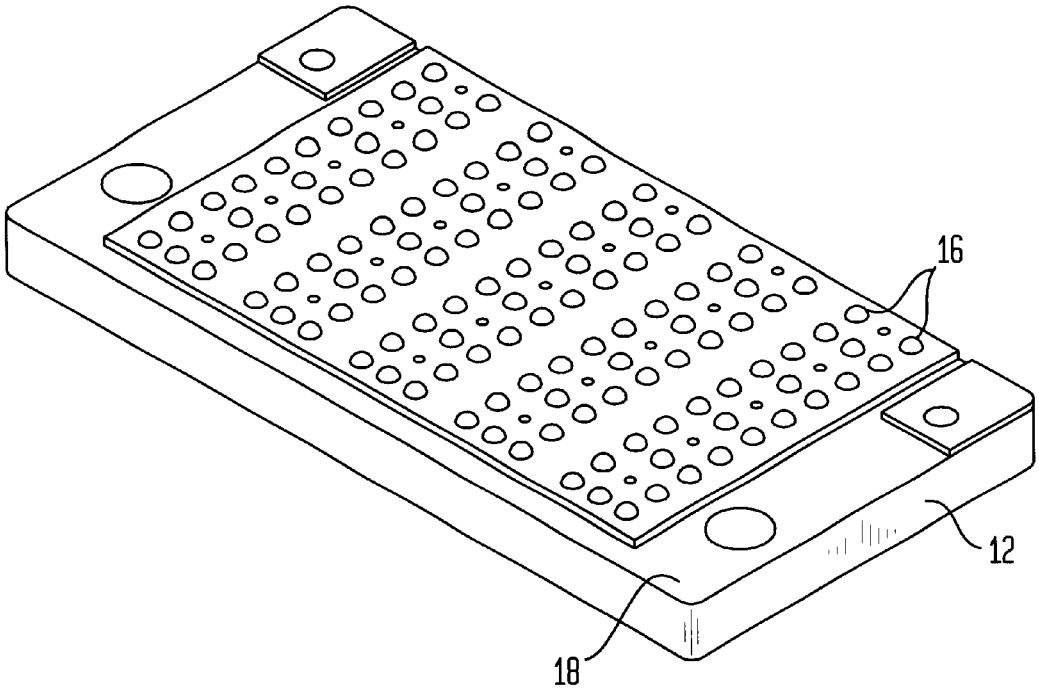
FIG. 2 is an isometric front view of a current projection block having wire wrap pins.

FIG. 1. Illustrates the back 10 of a relatively standard protection block 12 with wire wrap pins 14 projecting through cylindrical openings 16 (FIG. 2) on the front 18 of block 12. In the prior art, wire not shown, is wrapped in a spiral fashion around the pins 14 to provide contact. As described later in the specification, the disclosure of the present invention can make use of protection block 12.

Figure 3:
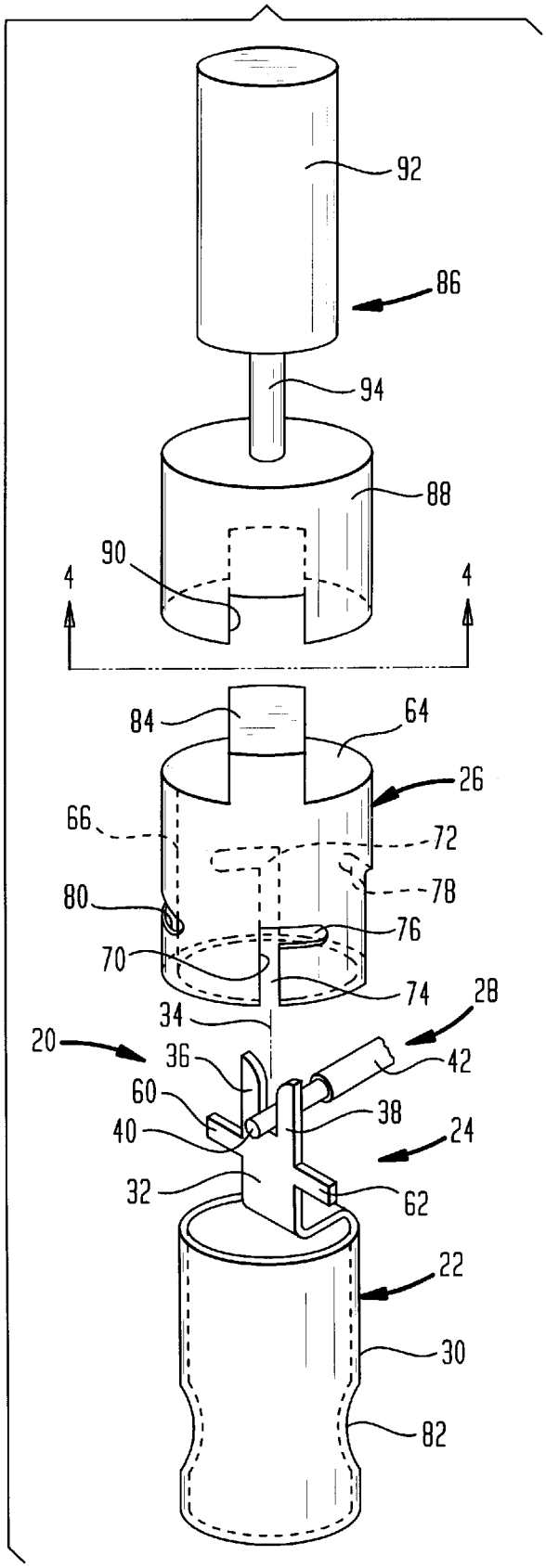
FIG. 3 is an exploded view of an IDC connection and tool according to the disclosure.

FIG. 3 illustrates an IDC pin and strain relief cap assembly 20 having an IDC contact 22 terminating at one end in a retainer clip 24 that is. engageable with a strain relief cap 26 to retain a wire 28. IDC contact 22 includes a cylindrical hollow body portion 30 having a significant length to engage and be retained by a pin 14 on protection block 12. Opposite from body portion 30 of IDC contact 22, retaining clip 24 includes a bifurcated end 32 having a slot 34 defined by a pair of arms 36 and 38. to grasp and retain wire 28. Wire 28 is of a type commonly used to transmit electricity or signals and includes a center portion 40 made, for example, of solid copper that is surrounded by appropriate insulation 42 to protect center portion 40 from the exterior environment.

Figure 5:
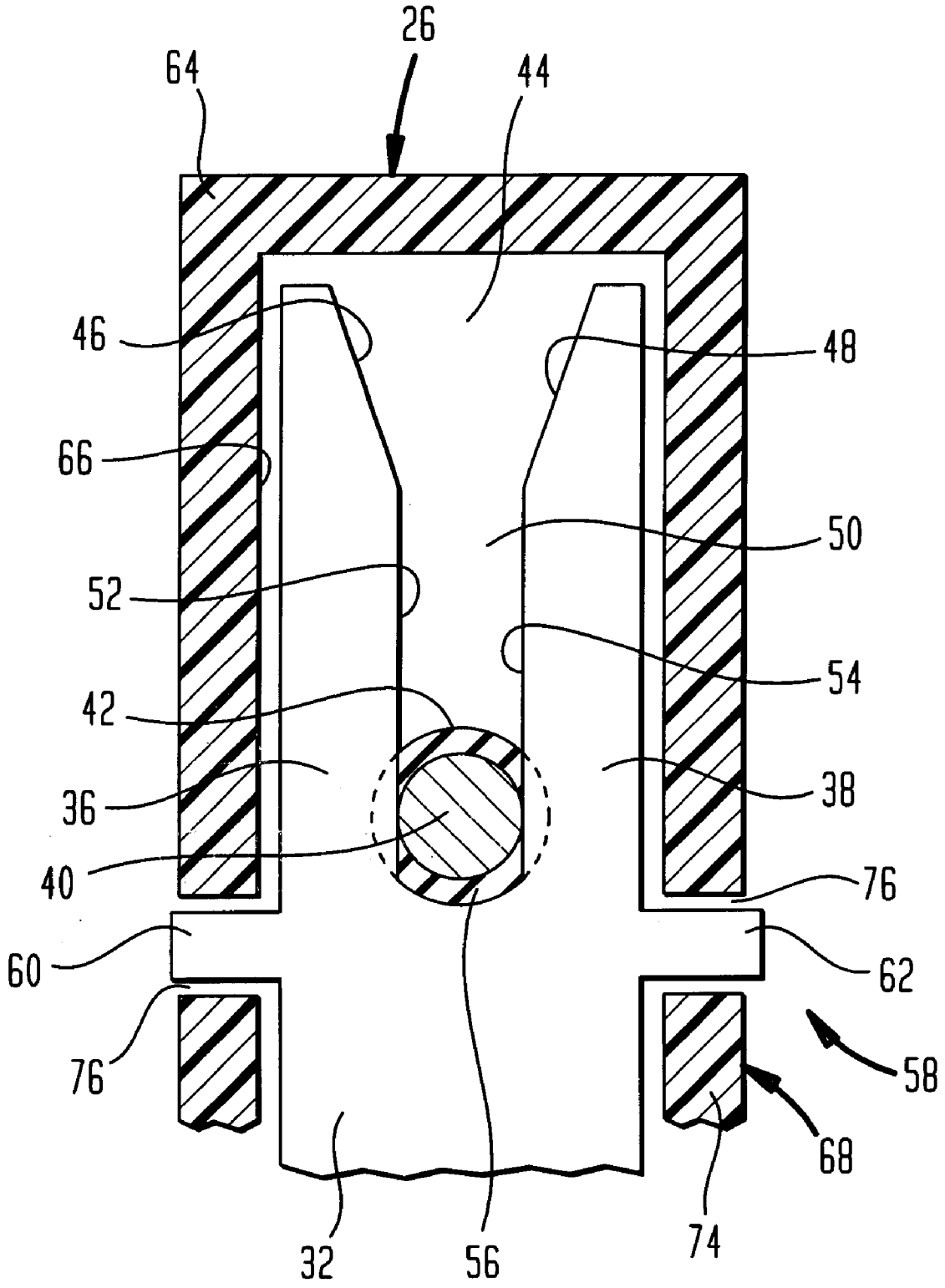
FIG. 5 is an enlarged sectional view of a portion of the IDC connection according to the disclosure.

As depicted in FIG. 5, slot 34 of bifurcated end 32 is defined by an entry section 44 having a pair of angled surfaces 46 and 48 terminating at an end portion 50 defined by parallel sides 52 and 54 and a curved end 56. Parallel sides 52 and 54 are spaced a distance apart that is slightly less than the diameter of center portion 40 of wire 28. Curved end 56 is of a shape to conform to a portion of the wire 28. In assembly the wire moves into bifurcated end 32 between arms 36 and 38, by angled surfaces 46 and 48 into end portion 50 whereby parallel sides 52 and 54 cut through the insulation 42 of wire 28 thereby malting contact with center portion 40 of wire 28. The wire is moved in a direction until contact is made between wire 28 and end portion 56 of bifurcated end 32 of IDC contact 22.

IDC contact 22 is preferably made of a standard metal material such as a steel alloy coated with brass to transmit electrical signals or electricity to the pins 14. In the preferred embodiment, retaining means 58 comprises retaining cams 60 and 62 connected to arms 36 and 38 of bifurcated end 32, which cams are inflexible and extend outwardly at an angle as shown in FIGS. 3 and 5. These retaining means 58 will be discussed in greater detail in reference to assembly of strained relief cap 26 with IDC contact 22 of assembly 20.

Strain relief cap 26 includes a body portion 64 defining a cavity 66 to receive bifurcated end 32 of IDC contact 22. Body portion 64 includes gripping means 68 illustrated as a pair of locking windows 70 and 72 oppositely spaced on body portion 64 to receive and retain retaining cams 60 and 62 when bifurcated end 32 is located within cavity 66.

In a preferred embodiment, the retaining cams 60 and 62 are located diametrically opposed from one another. The locking window 70 and 72 are similarly located to correspond to the location of retaining cams 60 and 62. As best shown in FIG. 3, the locking windows may be of a shoeshape or "L" configuration, each having a longitudinally extending entry slot 74 that terminates in a laterally or circumferentially extending slot 76 to retain retaining cams 60 and 62 as illustrated in FIG. 5. In its preferred embodiment, strain relief cap 26 is a cylindrical, cup-shaped member having axially extending entry slots opening into the open end of the cap. Wire slots 78 and 80 have been positioned diametrically opposed from one another to receive wire 28. It should be appreciated that only one wire slot 78 is needed, if it is chosen to terminate center portion 40 within cavity 66 of strain relief cap 26. Wire slots 78 and 80 may be configured similar to locking windows 70 and 72. Further, although bifurcated end 32 may extend upwardly from a side surface of contact 22, it is preferred to bend it in a know matter relative to the side surface toward the axis of cylindrical portion 30 and then upwardly along the axis to center the bifurcated end 32 relative to cylindrical portion 30 as illustrated in FIG. 3. In this manner a cylindrical cap 26 can be positioned axially around a portion of cylindrical portion 30.

In assembly, IDC contact is engaged with a pin. 14 extending outwardly from a block 12. The end of a wire 28 is located within bifurcated end 32. a distance to ensure contact of the wire across the entire length of groove 34 of bifurcated end 32. The wire is moved downwardly between angled surfaces 46 and 48 to a position in contact with parallel sides 52 and 54. Strain relief cap 26 is then located over bifurcated end 32, with bifurcated end 32 within cavity 66. The cap 26 is aligned with bifurcated end 32 to ensure that longitudinally extending entry slot 74 of locking windows 70 and 72, are respectively aligned with retaining cams 60 and 62. Additionally, the longitudinally extending entry slot 74 of wire slot 78, must be aligned with wire 28. The cap is then moved downwardly over bifurcated end 32 until contact is made with the top portion of retaining cams 60 and 62, with the upper portions of circumferentially extending slot 76 of locking windows 70 and 72. Wire slot is so configured that at this position, room is provided between the upper surface of circumferentially extending slot 76 of wire slot 78 with the insulation 42 of wire 28. If a second wire slot 80 is provided in retaining cap 26, this slot will be configured similar to wire slot 78, allowing for the wire to extend through the retaining cap. It should be appreciated that the wire slot 80 is not needed and that wire 26 may terminate within cavity 66 of retaining cap 26. Once contact is made between the upper surfaces of retaining cams 60 and 62 with the upper surfaces of circumferentially extending slots 76 of locking windows 70 and 72, the cap may then be twisted as shown in FIG. 3, in a clockwise direction to lock retaining cams 60 and 62 at the end portion of locking windows of 70 and 72 to thereby releasably retain cap 26 relative to contact 22.

As is known to those skilled in the art, retaining cams 60 and 62, along with circumferentially slot 76 of locking windows 70 and 72, may be so constructed as to ensure tight and relatively permanent engagement of cap 26 relative to contact 22.

It is possible to construct cap 26 in other configurations other than cylindrical. The significance of the configuration of the cap is to ensure the presence of the longitudinally extending entry slot 74 and circumferentially extending slot 76 to retain the retaining cams 60 and 62. It is also necessary to ensure that at least one other slot 78, having a similar configuration, is provided so that during assembly of cap 26, relative to contact 22, the retaining cams 60 and 62 and wire 28 may move in a general longitudinal direction along longitudinally extending entry slots 74 and then be free to move in a general lateral or circumferential direction along circumferentially extending slots 76 of locking windows 70 and 72 and wire slot 78, and 80 if provided. If, for example, cap 26 would be square or rectangular, retaining cams 60 and 62 would have to be long enough to continue engagement with body portion 64 of cap 26 during twisting movement of cap 26 relative to contact 22.

To disassemble cap 26 from contact 22, a reverse, or clockwise twisting action as shown in FIG. 3, will be employed until wire 28 and retaining cams 60 and 62 are aligned with the respective longitudinally extending entry slots 74 and then the cap may be moved longitudinally upward away from the contact, thereby exposing the wire within the bifurcated end 32.

It should be appreciated that the cap 26 is also so constructed to allow for automated assembly of assembly 20 with pins 14. To this end, it is desirable, to design the contacts 22 in cap 26 in a consistent manner to allow for first placement of the wire in the slots 34, and then rapid movement and twisting of the cap 26 relative to the contact 22. Insertion of the contact 22 into the respective pin may occur before or after securement of cap 26 to contact 22.

Further, end 30 of contact 22 is constructed in a known manner to be engaged with or disengaged from a pin 14 in a rapid manner when it is necessary to change contact points for the wires 28 relative to the pins 14 on block 12. Retention means in the form of an annular indentation 82 on end 30 can be used for this purpose.

Figure 4:
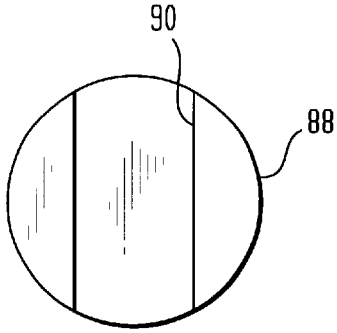
FIG. 4 is a side elevation view taken generally along line 4—4 of FIG. 3.

Up to this point in the detailed description of the invention, the disclosure is similar to that disclosed in co-pending U.S. patent application Ser. No. 09/482,898 filed on the same day by the co-inventors and assigned to the assignee of this application. As illustrated in FIGS. 3 and 4, the top of relief cap is configured to have a raised portion 84 extending longitudinally away from the cap 26 to form a gripping section.

An assembly tool 86 is provided having a holding section 88 with a slot 90 configured for mating engagement with raised portion 84 as best seen in FIGS. 3 and 4. Tool 86 includes another portion 92 secured to section 88 that may be configured to be gripped by a hand for turning tool 86 laterally or circumferentially in a clockwise or counterclockwise rotation to turn cap 26 relative to contact 22. In this way, more torque may be applied to cap 26 to secure it to or release it from contact 22.

Further, the portion 92 to be held may be moved a distance away from holding section 88 by a connecting shaft 94 to allow for insertion of the section 88 and a cap 26 into space limited areas where a plurality of pins 14 are located on a block 12. Without assembly tool 86, it could be difficult to locate these caps 26 on contacts 22 and turn them by fingers on the human hand.

Additionally, in instances where the cap 26 is already secured to a contact 22 away from a block 12, tool 86 allows for gripping of the strain relief assembly 20 and locating it on a pin 14. In such instances contact is made with slot 90 and raised portion 84 and the strain relief assembly is located on a pin 14 projecting upwardly through the hollow portion 30. Force can be exerted by tool 86 to move the contact into engagement with pin 14 against the resistance of indent 82. Also the connected part can thereafter be rotated, in assembly to align wire 28 relative to block 12 and the other connections.

What is claimed is:

1. A method of securing a wire to an IDC contact that may be electrically engaged with a protective block comprising the steps of, irrespective of sequence:

a. providing a metal IDC contact having (i) a first end having a portion to engage an electrical connection on set protector block to retain said IDC contact relative to said block, (ii) a bifurcated end having spaced longitudinally extending arms with inwardly facing opposed surfaces spaced a distance to retain a wire located between said opposed surfaces, and (iii) a pair of cams on said bifurcated end extending laterally away from each of said longitudinally extending arms;

b. providing an open ended box-shaped strain relief cap that is configured to encircle said bifurcated end and enclose said bifurcated end on one end, said relief cap having (i) a pair of generally opposed cam slots extending along the circumference of said box-shaped member and each configured for engagement with one of said laterally extending cams, (ii) a wire slot extending along the circumference of said box-shaped member; and (iii) a plurality of longitudinally extending slots opening at one end into the open end of said box-shaped strain relief cap and terminating at the other end into one of said circumferentially extending cam and wire slots to form with said slot a generally "L" shaped slot, each of said generally "L" shaped slots being aligned in the same "L" shaped position relative to one another;

c. providing a wire to be attached to said IDC contact;

d. providing a tool to grip the exterior surface of said open ended box-shaped strain relief cap;

e. inserting said wire between said inwardly facing opposed surfaces of said IDC contact; then, f. locating said relief cap over said bifurcated end with said longitudinal cam slots aligned with said cams and said longitudinal wire slot aligned with said wire; and then irrespective of sequence;

g. moving said relief cap longitudinally relative to said bifurcated end to force said cams into said longitudinally extending cam slots; and h. gripping said relief cap with said tool; and then, i. twisting said relief cap relative to said bifurcated end with said tool to move said cams and said wire into said respective circumferential cam and wire slots.

2. A method according to claim 1 wherein the strain relief cap is provided as a generally cylindrical cup-shaped member.

3. A method according to claim 1 wherein a. said cam slots are diametrically opposed; and, b. said wire slot is located equally between said cam slots.

4. A method according to claim 1 wherein a. there are two wire slots on opposite sides of said box-shaped member; and, b. said wire is located within each of said wire slots.

5. A method according to claim 1 wherein a. said first end of said metal IDC contact is a hollow, cylindrically shaped member;

b. said electrical connections on said protective block are pins; and, c. said hollow, cylindrically shaped member is moved into contact with one of said pins during assembly.

6. A method according to claim 1 wherein a. the closed end of said box-shaped strain relief cap includes a raised portion having a given configuration; and, b. said tool includes a holding section having a slot configured for gripping engagement of said raised portion whereby rotation of said tool will result in rotation of said cap when said slot is engaged with said raised portion.

7. A method according to claim 1 wherein said tool includes a. a holding section to twist said relief cap relative to said bifurcated end; and, b. another portion connected to said holding section and spaced from said holding section, said other section being configured to be gripped by a human hand.

8. A method according to claim 1 wherein a. said first end of said metal IDC contact has a hollow, cylindrical shaped portion that projects along an axis;

b. said bifurcated end is generally axially aligned with said axis of said hollow, cylindrical shaped portion; and, c. said relief cap is a generally cylindrical cup-shaped member that may be axially aligned with said hollow, cylindrical shaped portion and said bifurcated end and have a cylindrical body portion of significant length to enclose said bifurcated end and a portion of said hollow, cylindrically shaped portion of said metal IDC contact.

* * * * *